United States Patent [19]

Mize

[11] 4,262,561

[45] Apr. 21, 1981

[54] RATCHET AND GEAR DRIVE SOCKET WRENCH HANDLE

[76] Inventor: Lee S. Mize, 1652 16th Rd., Fruita, Colo. 81521

[21] Appl. No.: 107,669

[22] Filed: Dec. 27, 1979

[51] Int. Cl.[3] ..... B25B 17/00

[52] U.S. Cl. ..... 81/57.29; 81/58.1; 81/177 E; 81/177 ST

[58] Field of Search ..... 81/57.29, 58.1, 177 B, 81/177 E, 177 ST

[56] References Cited

U.S. PATENT DOCUMENTS

| | | | |
|---|---|---|---|
| 1,810,006 | 6/1931 | Edwards | 81/177 ST |
| 2,703,030 | 3/1955 | Marvin | 81/57.29 |

*Primary Examiner*—James L. Jones, Jr.
*Attorney, Agent, or Firm*—Harvey B. Jacobson

[57] ABSTRACT

An elongated handle is provided defining a hand grip at one end and an enlarged head at the other end. The enlarged head has a reversible ratchet-type drive assembly supported therefrom including a rotary output shaft disposed transverse to the handle. The handle is tubular intermediate the handle and head ends thereof and rotatably receives a torque input shaft extending therethrough. The torque input shaft and output shaft include meshed gear wheels and the end of the input shaft adjacent the hand grip includes first torque transfer structure. An elongated head is positioned adjacent and disposed transverse to the hand grip in alignment therewith and includes laterally projecting second torque transverse structure releasably coupled with the first torque transverse structure. The elongated head, on the side thereof remote from the head end of the handle, defines an elongated laterally opening groove formed therein and an elongated crank arm has one end pivotally mounted in one end of the groove for swinging of the crank arm between a retracted position within the groove and an extended position projecting endwise outwardly of the aforementioned one end of the groove. The other end of the crank arm includes a right angulated terminal end portion generally paralleling the handle when the crank arm is in both the retracted and extended positions.

7 Claims, 6 Drawing Figures

RATCHET AND GEAR DRIVE SOCKET WRENCH HANDLE

BACKGROUND OF THE INVENTION

Various forms of speed ratchet handles heretofore have been provided including rotary shafts extending longitudinally thereof and journaled therefrom with the shafts including gears meshed with the rotary heads carried by the ratchet handles. In addition, the ends of the rotary shafts remote from the ratchet handle heads have been provided with various forms of crank arms for rotating the shafts. However, these previously known forms of speed ratchet handles have for various reasons been cumbersome to utilize in at least some circumstances. Examples of various forms of speed ratchet handles including some of the general structural and operational features of the instant invention are disclosed in U.S. Pat. Nos. 2,703,030, 2,787,183, 3,707,893, 3,733,936, and 4,086,829.

BRIEF DESCRIPTION OF THE INVENTION

The speed ratchet of the instant invention is constructed in a manner whereby a basically conventional ratchet handle may be provided with a crank whereby the rotary output shaft of the ratchet-type head of the handle may be rotated against low torque transfer loads from a position remote from the ratchet handle head and independent of oscillation of the ratchet handle head.

The speed ratchet handle of the instant invention further is constructed in a manner whereby it provides a crank arm utilizable as a handle during the speed mode of operation thereof and which may be readily swung to a retracted position.

The main object of this invention is to provide a ratchet handle including structure whereby the rotary output shaft of the head thereof may be rapidly rotated against low torque loads from a position remote from the head of the ratchet handle.

Another object of this invention is to provide a speed ratchet handle in accordance with the preceding objects and constructed in a manner whereby the speed drive of the handle may be actuated from a position remote from the head of the associated ratchet handle and either in an oscillatory manner or a continuously rotating manner.

Another important object of this invention is to provide a speed ratchet handle including two components and constructed in a manner whereby it will require very little maintenance.

Yet another object of this invention is to provide a speed ratchet handle constructed in a manner and enable it to be readily operated in close clearance work situations.

A further object of this invention is to provide a speed ratchet handle which may be utilized either in a ratchet mode or a continuous rotation mode.

A final object of this invention to be specifically enumerated herein is to provide a speed ratchet handle in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
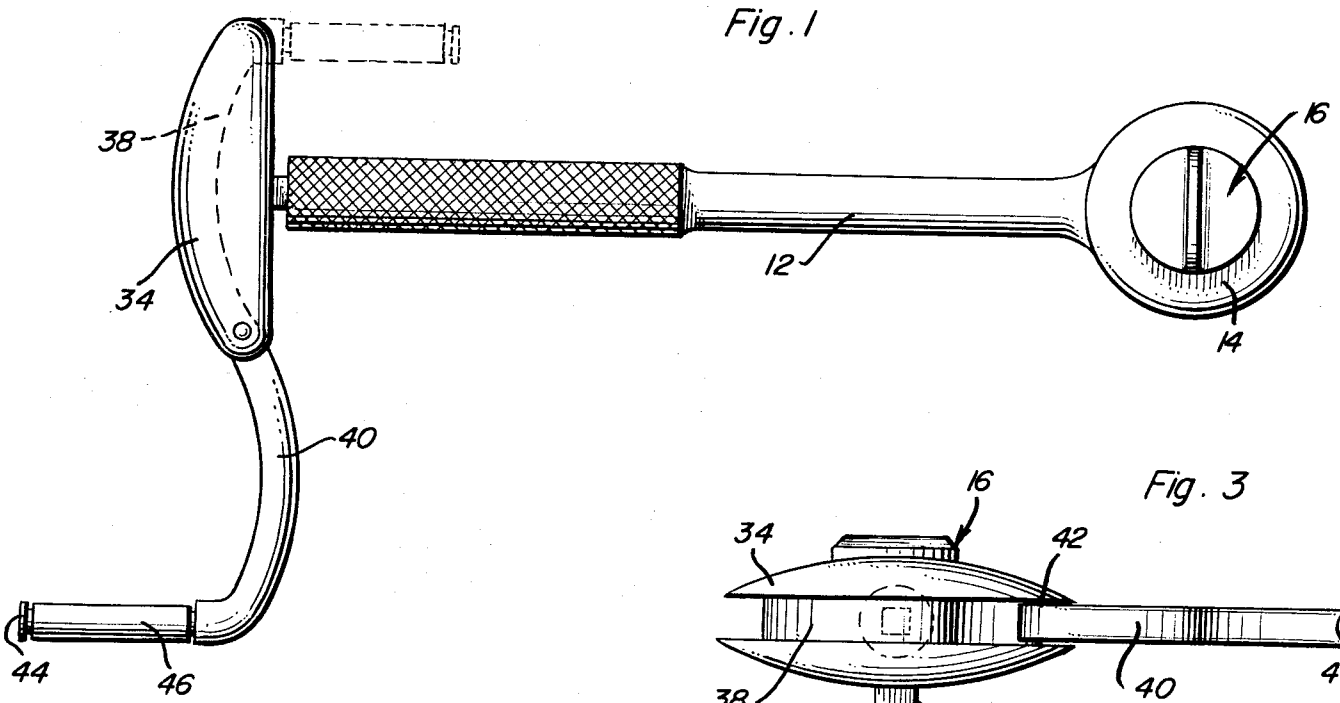
FIG. 1 is a plan elevational view of a speed ratchet handle constructed in accordance with the present invention, an alternate retracted position of the crank arm portion thereof being illustrated in phantom lines.
Figure 3:
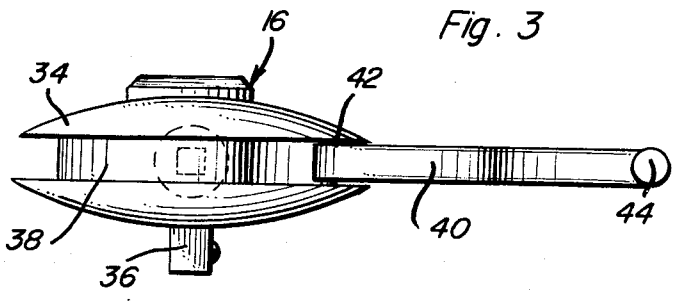
FIG. 3 is an end elevational view of the assemblage illustrated in FIG. 1 as seen from the left side thereof.
Figure 2:
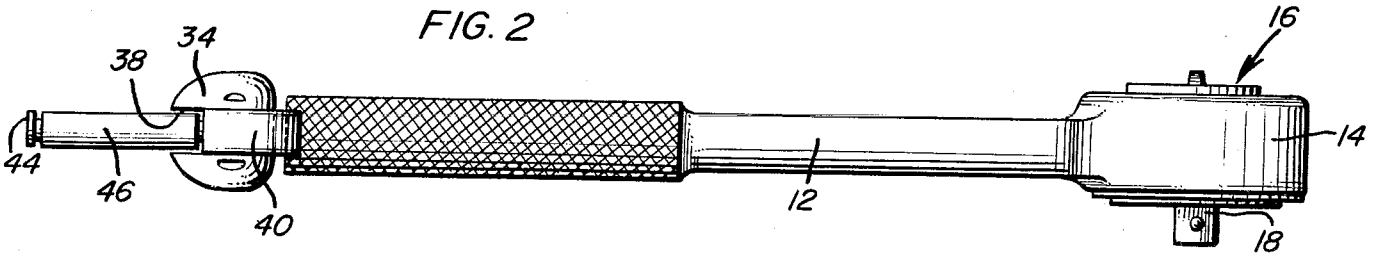
FIG. 2 is a side elevational view of the assemblage illustrated in FIG. 1.
Figure 4:
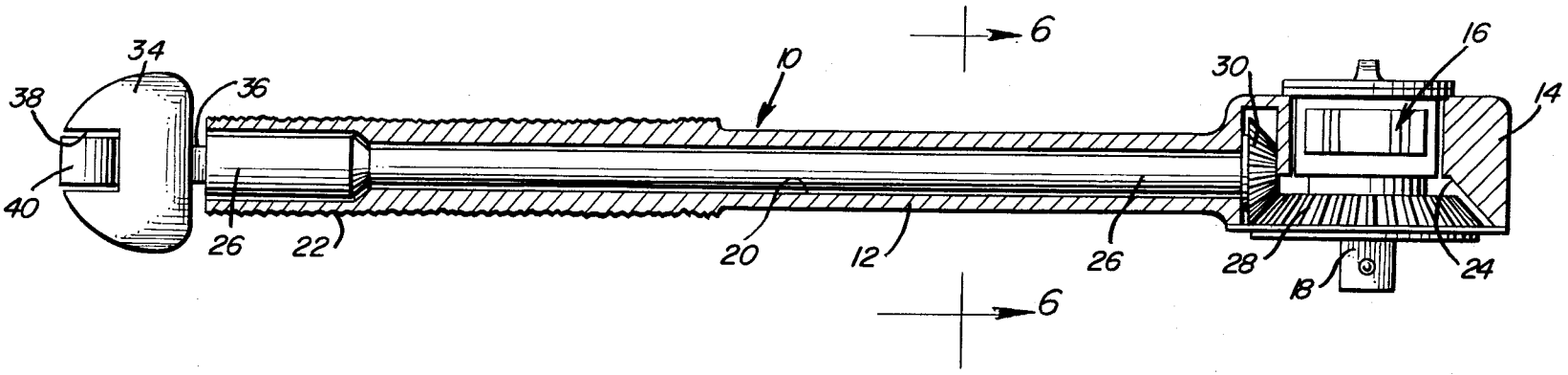
FIG. 4 is an enlarged fragmentary longitudinal vertical sectional view taken substantially upon a plane passing longitudinally along the ratchet handle.
Figure 6:
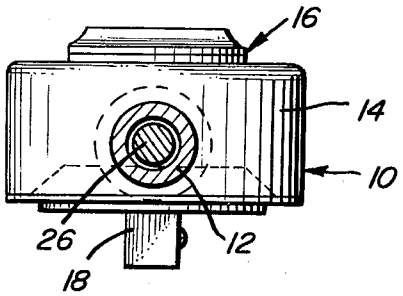
FIG. 6 is a fragmentary transverse sectional view taken substantially upon a plane indicated by the section line 6—6 of FIG. 4.
Figure 5:
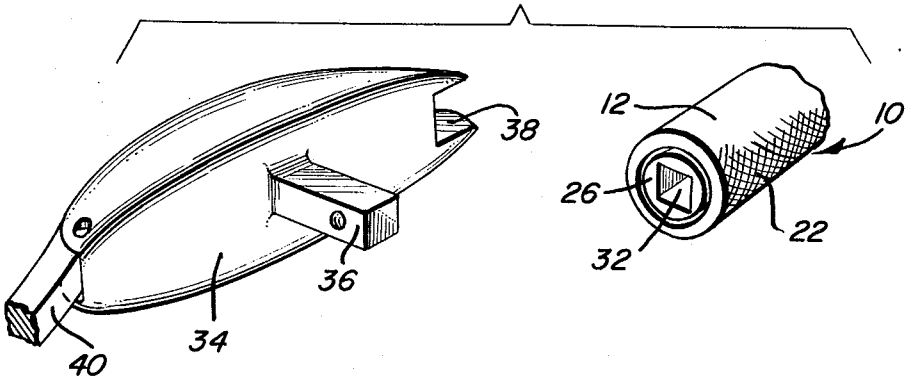
FIG. 5 is a fragmentary exploded perspective view of the hand grip end of the handle and the removable head and crank arm defining structure operationally associated therewith.

Referring now more specifically to the drawings, the numeral 10 generally designates the handle assembly of the instant invention. The assembly 10 includes an elongated handle 12 defining an enlarged head 14 on one end thereof. The enlarged head 14 has a conventional reversible ratchet-type drive assembly referred to in general by the reference numeral 16 supported therefrom including a rotary output shaft 18 disposed transverse to the handle 12 and adapted for releasable connection with a socket or other similar structure (not shown). The handle 12 is tubular and defines an elongated bore 20 opening endwise outwardly of the hand grip end 22 of the handle 12 at one end and into the interior cavity 24 of the head 14 in which the output shaft 18 is disposed.

The handle 12 rotatably receives a rotary torque input shaft 26 therein with the shaft 26 extending through the bore 20. The output shaft 18 has a gear wheel 28 mounted thereon with which a gear wheel 30 carried by the adjacent end of the shaft 26 is meshed. The end of the shaft 26 remote from the gear wheel 30 is disposed at the end of the bore 20 opening outwardly of the hand grip end 22 of the handle 12 and includes a non-circular recess 32.

An elongated head 34 is provided and includes a laterally outwardly projecting non-circular projection 36 centrally intermediate its opposite ends removably receivable in the non-circular recess 32 for drivingly coupling the head 34 to the shaft 26.

The side of the head 34 remote from the projection 36 defines an elongated longitudinally extending groove 38 formed therein and the groove 38 opens endwise outwardly of the opposite ends of the head 34.

One end of an elongated crank arm 40 is pivotably anchored in one end of the groove 38 as at 42 and is swingable between a retracted position substantially fully received within the groove 38 and an extended position projecting endwise outwardly of the end of the groove 38 in which the crank arm 40 pivotably anchored. The end of the crank arm 40 remote from the pivotal connection 42 defines a generally right angulated terminal end portion 44 having a sleeve 46 journaled thereon.

It may be seen from FIG. 1 of the drawings, that when the crank arm 40 is in the extended position thereof illustrated in solid lines the terminal end portion 44 generally parallels the handle 12 and projects away from the head 14 and that when the crank arm 40 is in the retracted phantom line position therein illustrated in FIG. 1, the terminal end portion 44 projects toward the head 14 of the handle 12. Also, it will be noted that the groove 38 is longitudinally arcuate and has its convex side opening endwise outwardly away from the head 14. Also, the crank arm 40 is of a similar arcuate configuration and is therefore substantially fully received within the groove 38 when the crank arm 40 is in the retracted phantom line position thereof illustrated in FIG. 1.

Inasmuch as the head 34 is slightly longitudinally convexly arcuate on the side thereof remote from the head 14, the head 34 may be readily engaged in the palm of the user's hand when the crank arm 40 is in the retracted position. In addition, inasmuch as the crank arm 40 is similarly arcuate, the latter may be utilized effectively as a crank arm by engagement of the sleeve 46 in one hand of the user and the hand grip 22 of the handle 12 in the other hand of the user.

Of course, it will be noted that the head 34 may be readily disengaged from the end of the shaft 26 opening endwise outwardly of the hand grip end 22 of the handle 12. When the head 34 is removed, the assembly 10 is operable in a manner identical to a conventional ratchet handle. However, in many instances it is desirable to engage the head 34 with the shaft 26 and to either utilize the head 34 for imparting rotation to the output shaft 18 without utilization of the crank arm 40 or to also use the crank arm 40.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an elongated handle defining a hand grip at one end and an enlarged head at the other end, said enlarged head having a reversible ratchet-type drive assembly supported therefrom including a rotary output shaft disposed transverse to said handle and adapted to have a rotary port transfer member supported therefrom for rotation therewith, said handle being tubular intermediate said one end and said rotary output shaft, a torque input shaft journaled in said handle, said output shaft and the adjacent end of said torque input shaft including meshed gear wheels mounted thereon, said input shaft end adjacent said one end of said handle including first torque transfer structure, an elongated grip positioned adjacent and disposed transverse to said one end of said handle in alignment with said torque input shaft and including lateral second torque transfer structure releasably engaged with said first torque transfer structure for removably coupling said hand grip to said torque input shaft, said hand grip, on the side thereof remote from said other handle end including an elongated laterally outwardly opening groove formed therein and extending longitudinally thereof, an elongated crank arm having one end pivotably mounted in one end of said groove for angular displacement about an axis transverse to said clamp arm and said groove between generally 180° relatively angularly displaced retracted and extended positions with said hand grip disposed in and extending longitudinally of said groove and projecting endwise outwardly of said one end of said groove, respectively, the other end of said crank arm including a terminal end portion disposed generally normal to said hand grip, generally paralleling said handle when said crank arm is in said retracted and extended positions and projecting away from said other end of said handle when said crank arm is in said extended position.

2. The combination of claim 1 wherein said side of said hand grip remote from said other handle end is outwardly convex, said groove being longitudinally arched and said crank arm also being longitudinally arched and conforming to said groove.

3. The combination of claim 1 wherein said terminal end portion includes a sleeve extending longitudinally thereof and rotatably mounted thereon.

4. The combination of claim 1 wherein said first torque transfer structure includes a non-circular recess formed in the end of said torque input shaft facing outwardly of said one end of said body, said second torque transfer structure comprising a non-circular projection of similar cross-sectional shape removably receivable in said recess.

5. The combination of claim 4 wherein said projection extends laterally outwardly of said hand grip centrally intermediate the opposite ends thereof.

6. The combination of claim 5 wherein said terminal end portion includes a sleeve extending longitudinally thereof and rotatably mounted thereon.

7. The combination of claim 6 wherein said side of said hand grip remote from said other handle end is outwardly convex, said groove being longitudinally arched and said crank arm also being longitudinally arched and conforming to said groove.

* * * * *